United States Patent [19]

Zeiffer et al.

[11] Patent Number: 5,063,646

[45] Date of Patent: Nov. 12, 1991

[54] MEANS AND METHOD FOR EXTRACTING MOISTURE FROM A TRAVELING WEB OF TEXTILE MATERIAL

[75] Inventors: Dieter F. Zeiffer, Iron Station, N.C.; John S. Samilo, Ringgold, Ga.

[73] Assignee: Gaston County Dyeing Machine Co., Stanley, N.C.

[21] Appl. No.: 558,669

[22] Filed: Jul. 27, 1990

[51] Int. Cl.[5] ..... D06B 15/00; D06B 1/16; D06B 5/08; D21F 3/10

[52] U.S. Cl. ..... 28/167; 34/115; 162/358

[58] Field of Search ..... 28/167; 34/115; 162/358, 203; 8/477

[56] References Cited

U.S. PATENT DOCUMENTS

| | | | |
|---|---|---|---|
| 1,251,173 | 12/1917 | Beregh, Jr. | 34/115 |
| 2,209,760 | 7/1940 | Berry | 34/115 X |
| 2,303,123 | 11/1942 | Johannessen | 34/115 X |
| 3,340,140 | 9/1967 | Heys | 162/358 |
| 3,655,507 | 4/1972 | Nykopp | 162/358 |
| 3,925,905 | 12/1975 | Zeiffer | 34/115 |
| 4,773,110 | 9/1988 | Hopkins | 8/477 X |

FOREIGN PATENT DOCUMENTS

| | | | |
|---|---|---|---|
| 0120472 | 10/1984 | European Pat. Off. | 8/477 |

*Primary Examiner*—Werner H. Schroeder
*Assistant Examiner*—John J. Calvert
*Attorney, Agent, or Firm*—Shefte, Pinckney & Sawyer

[57] ABSTRACT

Means and apparatus for extracting moisture from a traveling web of textile material containing high-moisture content processing fluid using a fluid applicator extending transversely across the path of the traveling web for applying low-moisture content fluid through holes in a distribution manifold on one side of the traveling web. A flow restricting roller is disposed on the opposite side of the traveling web in opposition to the fluid applicator holes closely downstream from the holes and serving to confine the low-moisture content fluid flow from the applicator into and through the traveling web, thereby causing displacement of high-moisture content fluid from the traveling web with low-moisture content fluid. The flow restricting roller is disposed at a spacing above the applicator less than the free-standing thickness of the traveling web and applies pressure to compress the traveling web and effect flow restriction.

7 Claims, 5 Drawing Sheets

MEANS AND METHOD FOR EXTRACTING MOISTURE FROM A TRAVELING WEB OF TEXTILE MATERIAL

BACKGROUND OF THE INVENTION

The present invention relates to means for extracting moisture from a traveling web of textile material, and particularly to such a means and method by which high-moisture content fluid is displaced from a traveling web with low-moisture content fluid.

In the manufacture of textile material in web form various processing steps involve the application of substances in liquid form, such as dye liquor and other chemicals, which inherently result in the traveling web containing liquid that must ultimately be removed during further processing. Conventionally, moisture containing textile webs are passed through dryer ovens after first being subjected to a mechanical moisture extraction to reduce the moisture content suitable for drying to a desired level in the oven. The more moisture that can be extracted prior to drying in the oven, the less time and energy is required in oven drying.

Conventionally, vacuum slots, squeeze rolls or air blowers or combinations thereof are used to extract excess moisture in advance of oven dryers. Vacuum slots draw air through the traveling web and thereby withdraw with the air excess moisture from the traveling web. Such vacuum slot arrangements require a substantial amount of air flow with a corresponding high energy requirement to create the vacuum for the flow, and the air flow further results in substantial undesirable noise. Squeeze rolls, on the other hand, compress the traveling web and thereby squeeze moisture therefrom. This can result in undesirable pressure being applied to the textile web and/or an uneven removal of moisture resulting in an uneven moisture level that can affect the uniformity of subsequent processing, such as subsequent dyeing. Also, squeeze rolls often are not capable of effectively removing sufficient moisture for subsequent efficient drying. Air blower arrangements also do not provide adequate control and uniformity of moisture removal and require substantial energy usage.

Therefore, there has been a need for a means and method for extracting moisture from a traveling web of textile material with uniformity and reliability of results in a controlled manner with low energy consumption.

SUMMARY OF THE INVENTION

The present invention provides means and method for extracting moisture from a traveling web of textile material by applying low-moisture content fluid to the traveling web while restricting the flow to uniformly and reliably displace high-moisture content processing fluid in a controlled manner using low energy consumption and without creating objectionable noise levels.

Briefly described, the means for extracting moisture according to the present invention includes a fluid applicator means extending transversely across the path of a traveling web that contains high-moisture content processing fluid. The fluid applicator means has a fluid distribution manifold extending transversely of the web path and opening means facing one side of the traveling web and communicating between the interior of the manifold and the traveling web for application therethrough of low-moisture content fluid from the manifold into the traveling web to displace high-moisture content processing fluid from the traveling web. Flow restricting means extend across the path of the traveling web facing the other side of the web in opposition to the fluid application means closely downstream from the opening means for confining low-moisture content fluid flow from the applicator means into and through the traveling web, thereby causing displacement of high-moisture content fluid from the traveling web with low-moisture content fluid.

Preferably, the flow restricting means and the applicator means define a web passage spacing therebetween less than the free-standing thickness of the traveling web to impose the confined flow of low-moisture content fluid. Also, preferably, the applicator means is disposed below the traveling web and the flow restricting means is disposed above the traveling web with the flow restricting means being a member at least partially supported on the traveling web to apply pressure thereto against the applicator means to compress the traveling web. In the preferred embodiment, the flow restricting means is a cylindrical roller rotatably mounted about an axis extending transversely of the traveling web.

According to the method of the present invention, low-moisture content fluid is applied transversely of the web path from one side thereof into the web to displace high-moisture content processing fluid while restricting fluid flow on the other side of the traveling web closely downstream of the fluid applying to confine low-moisture content fluid flow into and through the traveling web. Preferably the restricting restricts the traveling web to a transverse passage spacing less than the free-standing thickness of the traveling web with the restricting applying pressure to the traveling web to compress the traveling web and thereby restrict fluid flow.

Further features and advantages of the present invention will be apparent from the following detailed description of the preferred embodiment and from the accompanying drawings.

DETAILED DESCRIPTION OF THE PREFERRED EMBODIMENT

Figure 1:
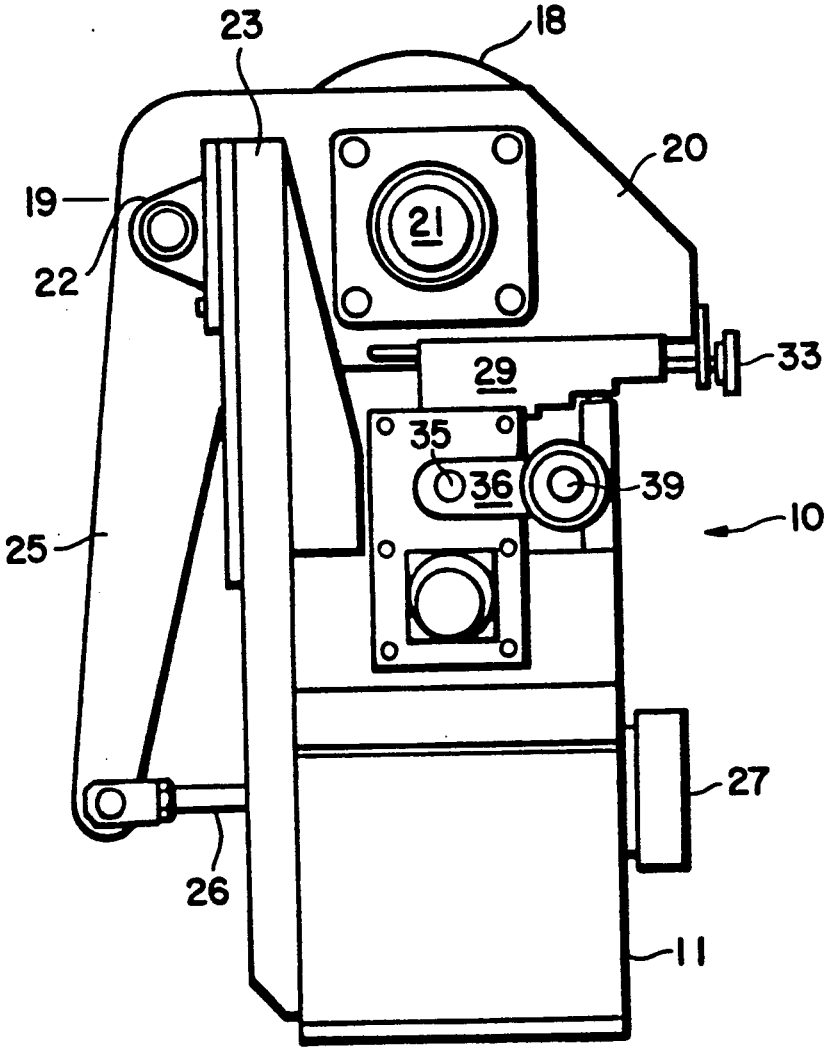
FIG. 1 is a side elevational view of a moisture extracting apparatus incorporating the means of the present invention for practicing the method of the present invention.
Figure 2:
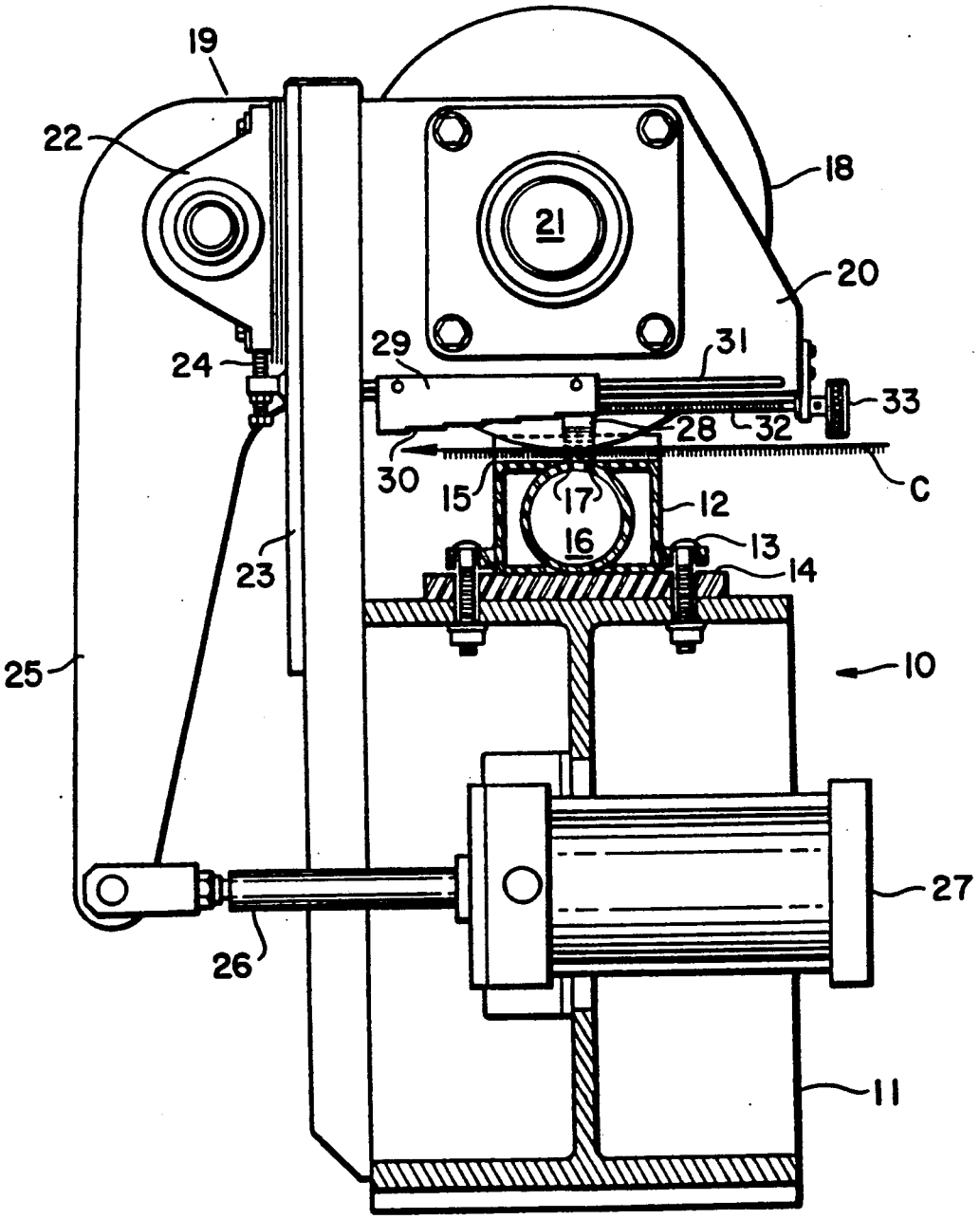
FIG. 2 is an enlarged view of the apparatus of FIG. 1, shown partially in section.
Figure 3:
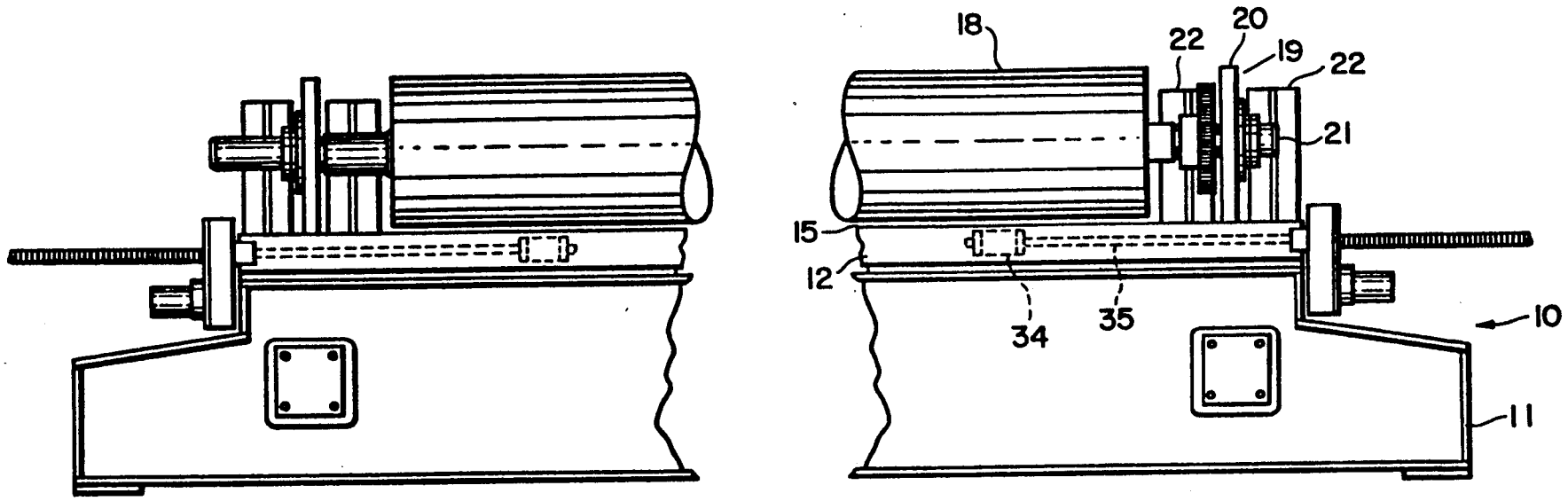
FIG. 3 is a front elevational view, partially broken away, of the apparatus of FIG. 1.
Figure 4:
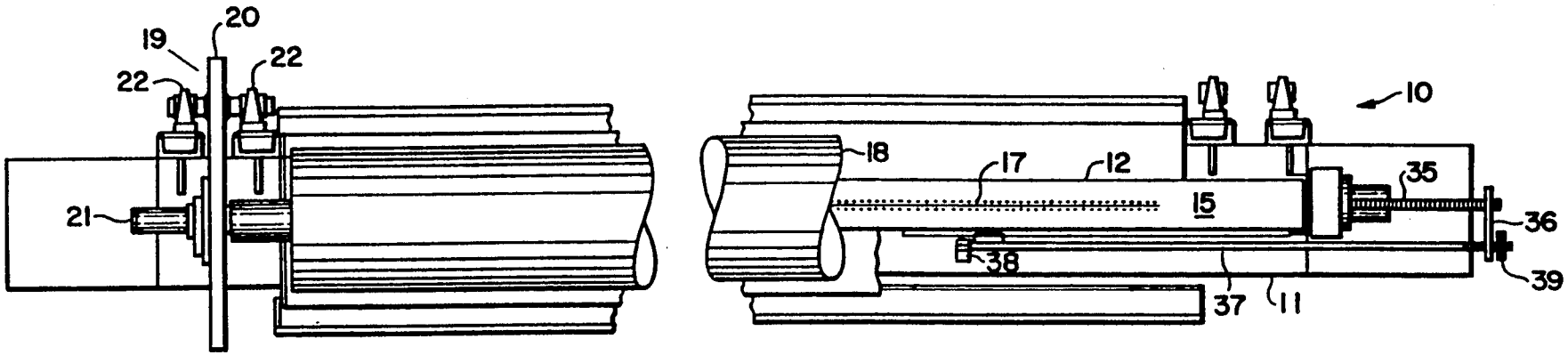
FIG. 4 is a top plan view, partially broken away, of the apparatus of FIG. 1.

With reference to the drawings, the preferred embodiment of the means for extracting moisture from a traveling web of textile material according to the present invention is in the form of an apparatus 10 through which a traveling web of textile material, such as carpet fabric C, travels in a continuous processing line downstream of the application of a processing liquid, such as dye liquor, and upstream of a drying oven.

The apparatus 10 includes a supporting frame 11 standing on a floor and extending upwardly for support thereon of a fluid apparatus means that extends transversely with respect to the traveling path of the carpet fabric C. This fluid application means includes a housing 12 having a rectangular cross-section and extending across the full width of the traveling carpet fabric C. The housing 12 is mounted by bolts to a supporting surface 14 of the frame 11. The housing 12 has a top face 15 over which the carpet fabric C passes. Contained within the housing 12 is a cylindrical manifold 16 that also extends the full width of the traveling carpet fabric C. This manifold 16 merges with the top face 15 of the housing 12 tangently therewith and has opening means in the form of a plurality of holes 17 arranged in two parallel rows extending across the width of the traveling carpet fabric C. Air or a conventional foam is introduced in a conventional manner into the manifold 16 for application to the carpet fabric C through the holes 17.

Figure 5:
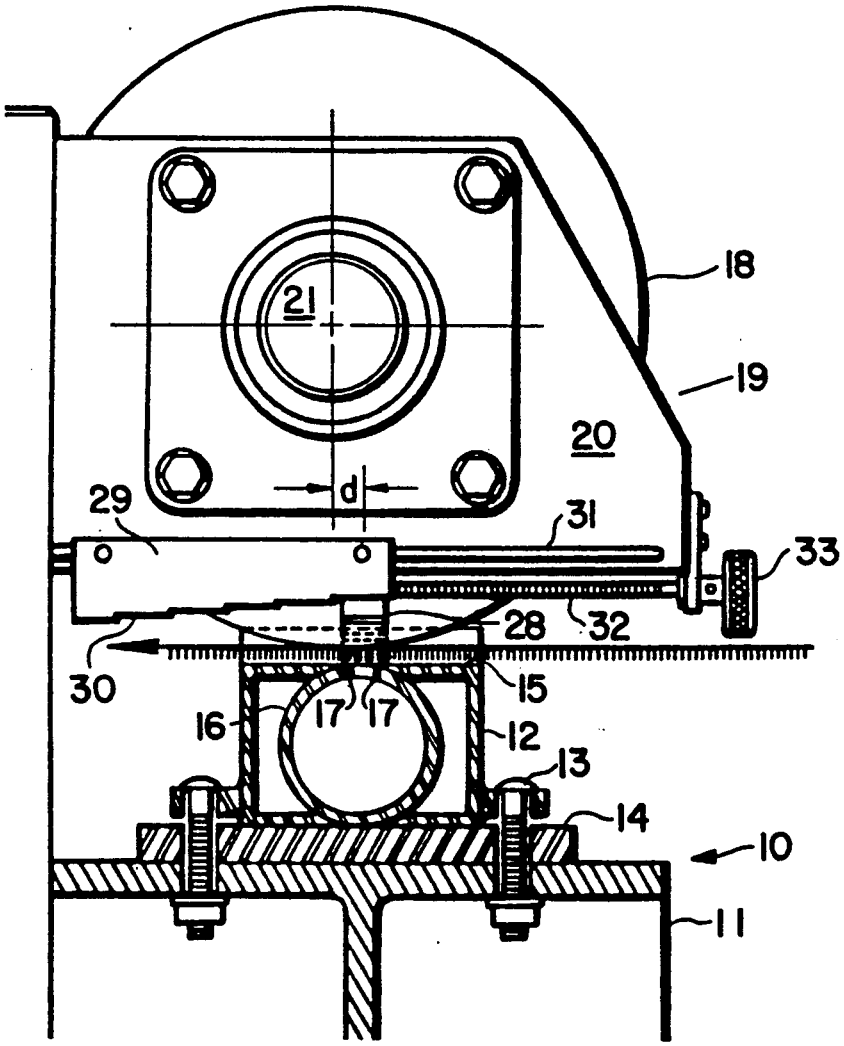
FIG. 5 is an enlarged elevational view, partially in section, of a portion of the apparatus of FIG. 1.

Flow restricting means in the form of a cylindrical roller 18 extends transversely across the travel path of the traveling carpet fabric C, with the applicator holes 17 facing one side of the traveling carpet fabric C from below and the flow restricting roller 18 facing the other side of the traveling carpet fabric C in opposition to the applicator holes 17 and closely downstream from the holes 17 for confining fluid flow from the applicator holes 17 into and through the traveling carpet fabric C, thereby causing displacement of high-moisture content fluid from the traveling web with low-moisture content fluid in the form of air or conventional foam. As seen in FIG. 5, the downstream distance between the centerline of the two rows of applicator holes 17 and the centerline of the roller 18 is designated by the letter "d". Preferably, the distance "d" is about $\frac{5}{8}$".

The cylindrical roller 18 is mounted in a mounting mechanism 19 that includes vertically disposed side flanges 20 in which ends 21 of an axial shaft of the cylindrical roller 18 are rotatably mounted to permit free rotation of the roller 18 under the influence of the traveling carpet fabric C to provide minimal resistance to travel of the carpet fabric C. The side flanges 20 are each mounted between a pair of pivot blocks 22 spaced in a downstream direction from the axis of the roller 18 and mounted on upstanding posts 23 of the apparatus frame 11 on each end of the frame 11. The pivot blocks 22 are vertically adjustable by vertical positioning screws 24 secured to the posts 23 and threadably adjustable in contact with the pivot blocks 22 for vertical adjustment thereof to best accommodate different thicknesses of traveling carpet fabrics C.

The side flanges 20 extend downwardly from the pivot blocks 22 in the form of lever arms 25, the lower ends of which are connected to the projecting ends 26 of horizontally extending piston-cylinder mechanisms 27 that are operable to pivot the side flanges 20 to raise the cylindrical roller away from the top face 15 of the applicator housing 12 to allow access thereto and also to permit threading of the carpet fabric C.

The cylindrical roller 18 is maintained at a spacing from the top face 15 of the applicator housing 12 to define a web passage spacing therebetween less than the free-standing thickness of the traveling carpet fabric C by spacing adjustment mechanisms associated with each side flange 20. These spacing adjustment mechanisms each include a vertical stop post 28 threaded in the flange 20 for vertical adjustment in line with and engagable with the top face 15 of the applicator housing 12. The stop post 28 is vertically adjustable in relation to a longitudinally adjustable gage plate 29 having a series of sequentially lower flat undersurfaces 30 that can be selectively drawn horizontally into alignment with the stop post 28 by sliding along a horizontal slide rod 31 by rotation of a threaded horizontal adjusting rod 32 that can be manually rotated by an adjusting knob at an end of the adjusting rod 32 projecting upstream outwardly of the side flange 20.

The apparatus 10 is capable of adjustment for applying fluid to carpet fabrics C of varying widths by adjustable end seal mechanisms operable in the opposite ends of the manifold 16. These end seal mechanisms include slide block 34 disposed in the ends of the manifold 16 and occupying substantially the full cross-section thereof to seal the holes thereat and also to provide a seal against fluid traveling therepast into the portions of the ends of the manifold 16 therebeyond. The slide blocks 34 are attached to adjusting rods 35 that extend outwardly through the ends of the manifold 15 and are threaded therein for axial movement to adjust the position of the slide blocks 34. Plates 36 are attached to the outer ends of the adjusting rods 35 and project in an upstream direction beyond the upstream extent of the applicator housing 12 for mounting therein of sighting rods 37 that extend inwardly parallel with the slide blocks 34 and have mounted at their inner ends sighting brackets 38 slidable along the frame 11 at the location of the slide blocks 34 to provide a visual indication of the location of the slide blocks 34 within the manifold 16. The sighting rods 37 are threadably adjusted in the plates 36 and are provided with adjusting knobs 39 for adjusting the position of the sighting brackets 38 in proper alignment with the slide blocks 34.

In operation, the apparatus 10 is first adjusted as described above to set the slide blocks 34 to seal the manifold 16 to the corresponding width of the carpet fabric C that is to be processed therethrough, and the stop posts 28 are adjusted as described above to provide the desired spacing of the passage for travel of the textile web between the top face 15 of the applicator housing 12 and the cylindrical roller 18. Then, air or conventional foam is introduced into the manifold 16 as the carpet fabric C travels through the apparatus 10. The carpet fabric C contains high-moisture content processing fluid, such as dye liquor, and the applicator applies the low-moisture content fluid in the form of the aforesaid air or conventional foam transversely of the fabric path into the traveling fabric to displace the high-moisture content processing fluid while fluid flow is being restricted on the other side of the traveling fabric by the roller 18 closely downstream of the fluid applying to confine the low-moisture content fluid flow into and through the traveling fabric, thereby displacing the high-moisture content fluid from the traveling fabric with the low-moisture content fluid so that the traveling fabric C exiting the apparatus 10 travels to the next processing stage, such as a drying oven, with substantially reduced moisture content.

The setting of the spacing of the roller 18 above the applicator housing 12 is adjusted to be less than the free-standing thickness of the traveling carpet fabric C so as to apply pressure to the traveling carpet fabric to compress it and thereby form a restriction that restricts flow of the applied low-moisture content liquid thereat and thereby enhance the flow of applied fluid in a relatively narrow upstream location at the applicator manifold holes 17 to enhance the action of the applied low-moisture content fluid in displacing the high-moisture content fluid.

The generation of the low-moisture content fluid such as air or conventional foam can be accomplished using conventionally available air pressure for a conventional foam generating mechanism. A manifold fluid pressure of about 12 psi has been found to provide suitable results in a typical operation.

Preferably, the roller 18 is rubber coated and it may alternatively be power driven for rotation rather than being freely rotatable.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. Means for extracting moisture from a traveling web of textile material containing high-moisture content processing fluid, comprising fluid applicator means extending transversely across a path of the traveling web, said fluid applicator means having a fluid distribution manifold extending transversely of one side of the web path and having opening means facing the traveling web and communicating between an interior of said manifold and the traveling web for application therethrough of low-moisture content fluid from the manifold into the traveling web to displace high-moisture content processing fluid from the traveling web, and flow restricting means extending across the path of the traveling web and facing another side of the web in opposition to said fluid application means closely downstream from said opening means for confining low-moisture content fluid flow from said applicator means into and through the traveling web, thereby causing displacement of high-moisture content fluid from the traveling web with low-moisture content fluid.

2. Means for extracting moisture according to claim 1 wherein said flow restricting means and said applicator means define a web passage spacing therebetween less than a free-standing thickness of the traveling web.

3. Means for extracting moisture according to claim 2 wherein said applicator means is disposed below the traveling web and said flow restricting means is disposed above the traveling web and comprises a member at least partially supported on said traveling web to apply pressure thereto against said applicator means to compress the traveling web.

4. Means for extracting moisture according to claim 1, 2 or 3 wherein said flow restricting means comprises a cylindrical roller rotatably mounted about an axis extending transversely of said traveling web.

5. A method for extracting moisture from a traveling web of textile material containing high-moisture content processing fluid, comprising applying low-moisture content fluid transversely of a web path from one side thereof into the traveling web to displace high-moisture content processing fluid from the web, while restricting fluid flow on another side of the traveling web closely downstream of said fluid applying to confine low-moisture content fluid flow into and through the traveling web thereby displacing high-moisture content fluid from the traveling web with low-moisture content fluid.

6. A method for extracting moisture according to claim 5 wherein said restricting restricts the traveling web to a transverse passage spacing less than a free-standing thickness of the traveling web.

7. A method for extracting moisture according to claim 6 wherein said restricting applies pressure to the traveling web to compress the traveling web.

* * * * *